US009051676B2

(12) United States Patent
Leibman et al.

(10) Patent No.: US 9,051,676 B2
(45) Date of Patent: Jun. 9, 2015

(54) APPARATUS AND METHOD FOR UTILIZING A VENTURI EFFECT IN A DISPENSER

(75) Inventors: Alexander Leibman, Louisville, KY (US); Alaknanda Acharya, Louisville, KY (US); Paul Owen Davis, Louisville, KY (US); Jerrod Aaron Kappler, Louisville, KY (US); Christopher Omalley, Louisville, KY (US)

(73) Assignee: General Electric Company, Schenectady, NY (US)

( * ) Notice: Subject to any disclaimer, the term of this patent is extended or adjusted under 35 U.S.C. 154(b) by 1094 days.

(21) Appl. No.: 13/075,417

(22) Filed: Mar. 30, 2011

(65) Prior Publication Data

US 2012/0246836 A1 Oct. 4, 2012

(51) Int. Cl.
*D06F 39/08* (2006.01)
*D06F 39/02* (2006.01)

(52) U.S. Cl.
CPC ..... *D06F 39/088* (2013.01); *D06F 39/02* (2013.01)

(58) Field of Classification Search
CPC ..... D06F 39/022
See application file for complete search history.

(56) References Cited

U.S. PATENT DOCUMENTS

| | | | |
|---|---|---|---|
| 3,756,457 | A | 9/1973 | Holmes et al. |
| 3,982,666 | A | 9/1976 | Kleimola et al. |
| 4,090,475 | A | 5/1978 | Kwan |
| 4,434,629 | A | 3/1984 | Bianchi et al. |
| 6,301,734 | B1 | 10/2001 | Dunsbergen et al. |
| 6,401,499 | B1 | 6/2002 | Clark et al. |
| 7,036,175 | B2 | 5/2006 | Sears et al. |
| 7,481,081 | B2 | 1/2009 | Hsu et al. |
| 2006/0272360 | A1 | 12/2006 | Hsu et al. |
| 2007/0261177 | A1 | 11/2007 | Risen et al. |
| 2009/0095027 | A1 | 4/2009 | Deppermann et al. |
| 2009/0095750 | A1 | 4/2009 | Vitan et al. |
| 2009/0288454 | A1 | 11/2009 | Lee et al. |
| 2010/0205753 | A1 | 8/2010 | Kim et al. |

FOREIGN PATENT DOCUMENTS

WO 2010/026516 A1 3/2010

*Primary Examiner* — Jason Ko
(74) *Attorney, Agent, or Firm* — Global Patent Operation; Douglas D. Zhang

(57) ABSTRACT

An apparatus for delivering additive into a clothes basket and cleaning remaining additive from an additive container are provided. The apparatus includes a clothes basket rotatable about an axis, a motor coupled to the clothes basket, a Venturi component, an additive container connected to a vacuum area of the Venturi component through a U-tube, a water inlet connected to the Venturi component through an inlet hose, an outlet hose connecting the Venturi component to the clothes basket, a valve controlling flow of water into the inlet hose, a valve controlling flow of water into the additive container, and a processor coupled to the motor and the valves, the processor being operative to manipulate the valve controlling flow of water into the inlet hose and the valve controlling flow of water into the additive container to deliver additive into the clothes basket and to clean remaining additive from the additive container.

6 Claims, 17 Drawing Sheets

APPARATUS AND METHOD FOR UTILIZING A VENTURI EFFECT IN A DISPENSER

CROSS-REFERENCE TO RELATED APPLICATIONS

The present application is related to U.S. patent application Ser. No. 12/969,973 entitled "Apparatus and Method for Using a Dispensing System Utilizing a Venturi Component".

BACKGROUND OF THE INVENTION

The subject matter disclosed herein relates to appliances such as washing machines, and more particularly to dispensing systems and the like.

Within many washing machines, most additive dispensers use a siphon effect for dispensing, which requires a number of parts and components, and is associated with problems such as missing inserts, presence of residue, etc.

BRIEF DESCRIPTION OF THE INVENTION

As described herein, the example embodiments of the present invention overcome one or more disadvantages known in the art.

One aspect relates to an apparatus comprising: a clothes basket rotatable about an axis, a motor coupled to the clothes basket, a Venturi component, an additive container, wherein the additive container is connected to a vacuum area of the Venturi component through a U-tube, a water inlet connected to the Venturi component through an inlet hose, an outlet hose connecting the Venturi component to the clothes basket, a valve controlling flow of water into the inlet hose, a valve controlling flow of water into the additive container, and a processor coupled to the motor and the valves, the processor being operative to manipulate the valve controlling flow of water into the inlet hose and the valve controlling flow of water into the additive container to deliver additive into the clothes basket and to clean remaining additive from the additive container.

Another aspect relates to a dispensing cup apparatus comprising: one or more additive chambers, a dispensing cup cover, a motif fluid valve, wherein the motif fluid valve facilitates motif fluid to be mixed with additive from one or more of the one or more additive chambers carried to a washing chamber, and wherein the motif fluid valve also branches out to carry motif fluid towards the dispensing cup cover, and one or more channels to provide motif fluid flow along walls of the one or more additive chambers to wash the walls of the one or more additive chambers, wherein the one or more channels are formed based on shape of the dispensing cup with respect to shape of the cover.

Yet another aspect of the present invention relates to a method comprising the steps of manipulating a valve controlling flow of water into an inlet hose to deliver additive from an additive container through a Venturi component and out an outlet hose into a clothes basket, wherein manipulating a valve controlling flow of water into the inlet hose to deliver additive into a clothes basket comprises opening the valve controlling flow of water into the inlet hose, and wherein opening the valve controlling flow of water into the inlet hose enables water to flow through the Venturi component, creating a vacuum resulting in suction of additive from the additive container into the Venturi component, and wherein the additive is then carried by water to the clothes basket through the outlet hose, and manipulating a valve controlling flow of water into the additive container to clean remaining additive from the additive container, wherein manipulating a valve controlling flow of water into the additive container to clean remaining additive from the additive container comprises opening the valve controlling flow of water into the additive container to allow water to enter into the additive container.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more embodiments of the invention provide a method and/or apparatus to utilizing a Venturi effect in a dispenser for a washing machine. It should be noted, as detailed herein, that a Venturi component, an aspirator, an eductor, and a jet pump are largely interchangeable terms, as used herein.

Figure 1:
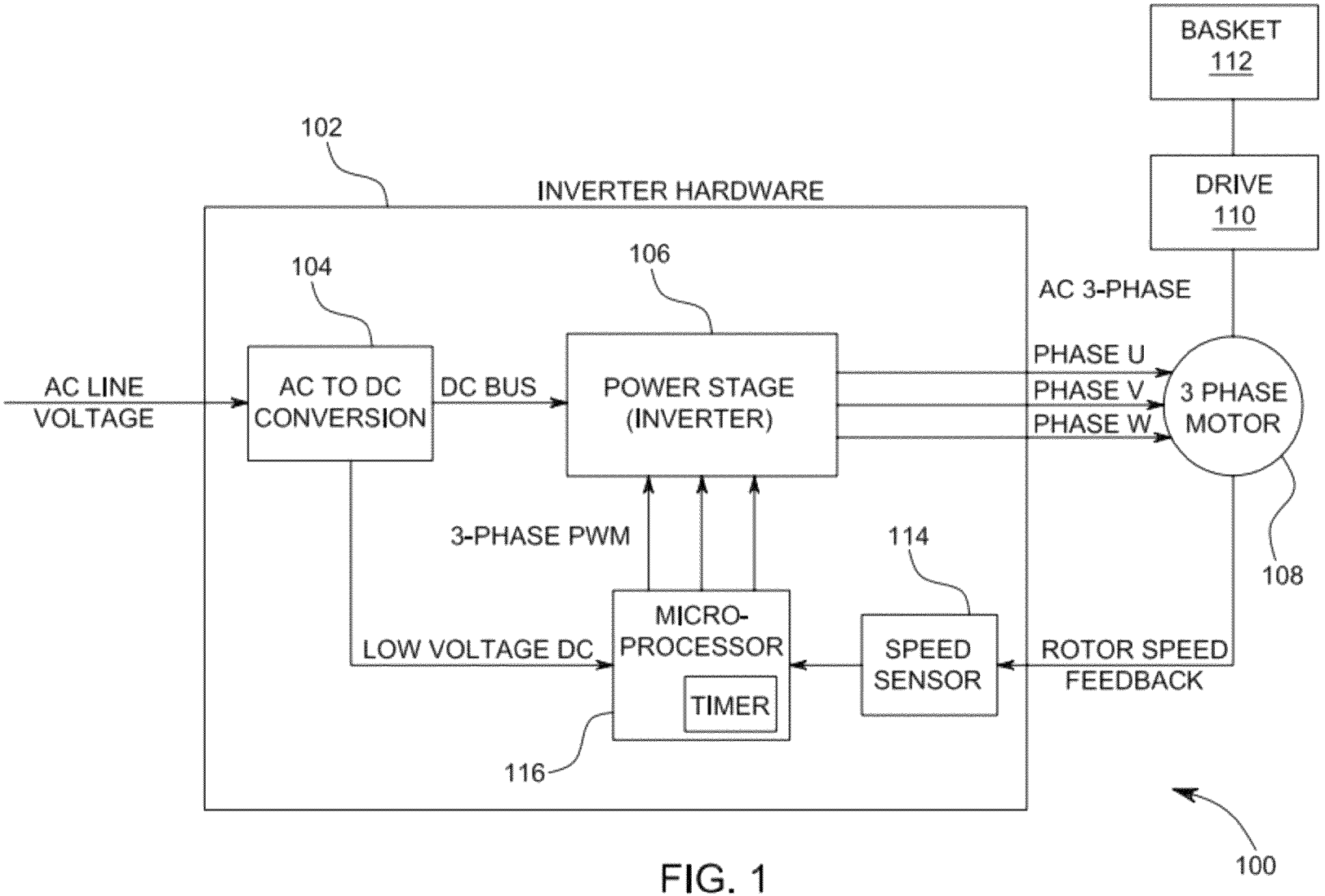
FIG. 1 is a block diagram of an example system, in accordance with a non-limiting example embodiment of the invention.

Reference should now be had to block diagram 100 of FIG. 1. Alternating current (AC) line voltage is supplied to inverter hardware 102. The AC is converted to direct current (DC) in block 104 using a rectifier or the like. Relatively high voltage DC is provided to a DC power bus and then to inverter 106 to provide 3-phase AC to 3-phase motor 108. Relatively low voltage DC is provided to microprocessor 116 which can include a suitable timer (not separately numbered). Motor 108 is coupled to basket 112 for receiving clothes to be washed, with a suitable drive 110. While in theory there could be a direct coupling, in practice, a suitable reduction arrangement is preferably employed, such as a pulley and belt arrangement, gearing, or the like, wherein basket 112 turns at a lower revolutions per minute (RPM) than motor 108. In a specific non-limiting example, the reduction is about 13.2 such that the RPM of basket 112 must be multiplied by 13.2 to obtain the motor shaft speed. Unless otherwise noted, the RPM values given herein are for the basket 112. A suitable sensor 114 is employed to provide feedback regarding the basket RPM value (or motor RPM value, since the relationship between the two is known based on the reduction of drive 110) to microprocessor 116. Microprocessor 116 is programmed, for example, with suitable software or firmware, to implement one or more techniques as described herein. In other embodiments, an application-specific integrated circuit (ASIC) or other arrangement could be employed.

The skilled artisan will be familiar with conventional washer systems and given the teachings herein will be enabled to make and use one or more embodiments of the invention; for example, by programming a microprocessor 116 with suitable software or firmware.

As used herein, a clothes washer refers to a system with a rotating clothes container. The axis of rotation of the clothes container may be vertical (for example, top load), substantially horizontal (for example, front load), or may even have an intermediate value. Typically, the system will include washing and spinning cycles, but one or more embodiments are applicable to systems with only a spin cycle; for example, an extraction machine. As noted, the rotational speed (angular velocity) of the basket (clothes container) 112 and/or the motor 108 is a significant parameter. It may be specified in RPM, radians per second, and so on.

Figure 2:
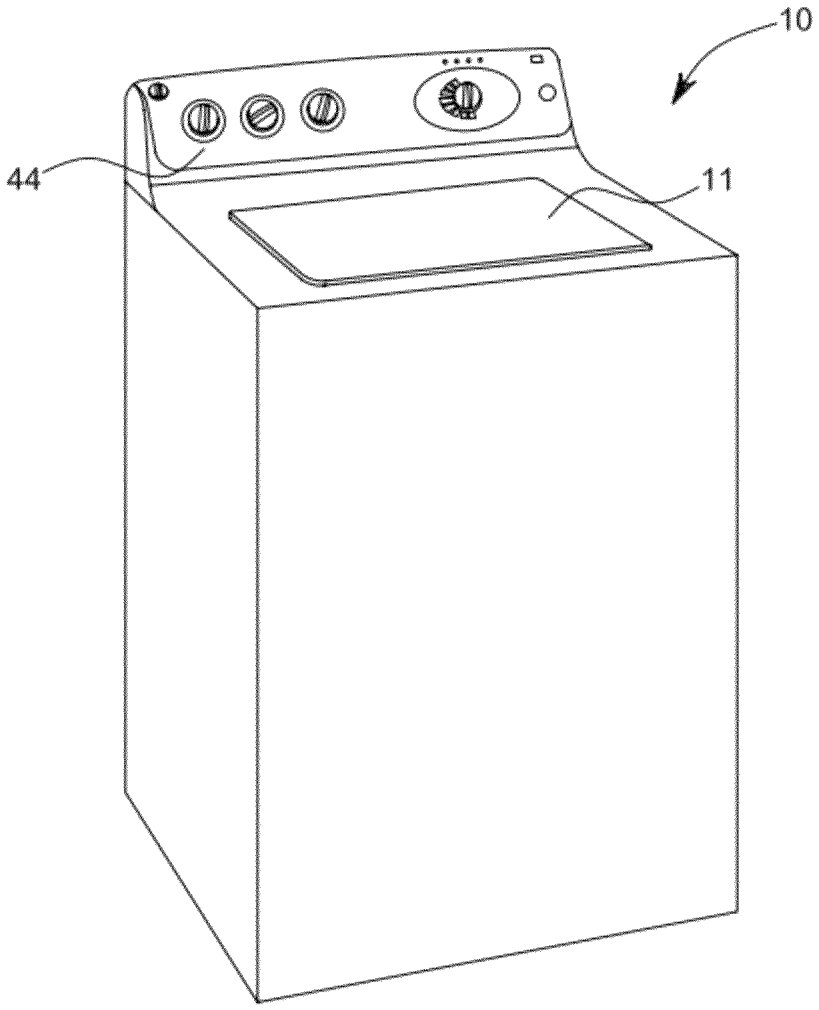
FIG. 2 is a pictorial view of an example top-loading washing machine.

FIG. 2 shows an example top-loading washing machine 10 including a control panel or portion 44 and a loading door 11. Machine 10 is a non-limiting example of a machine with which one or more aspects of the invention may be implemented.

Figure 3:
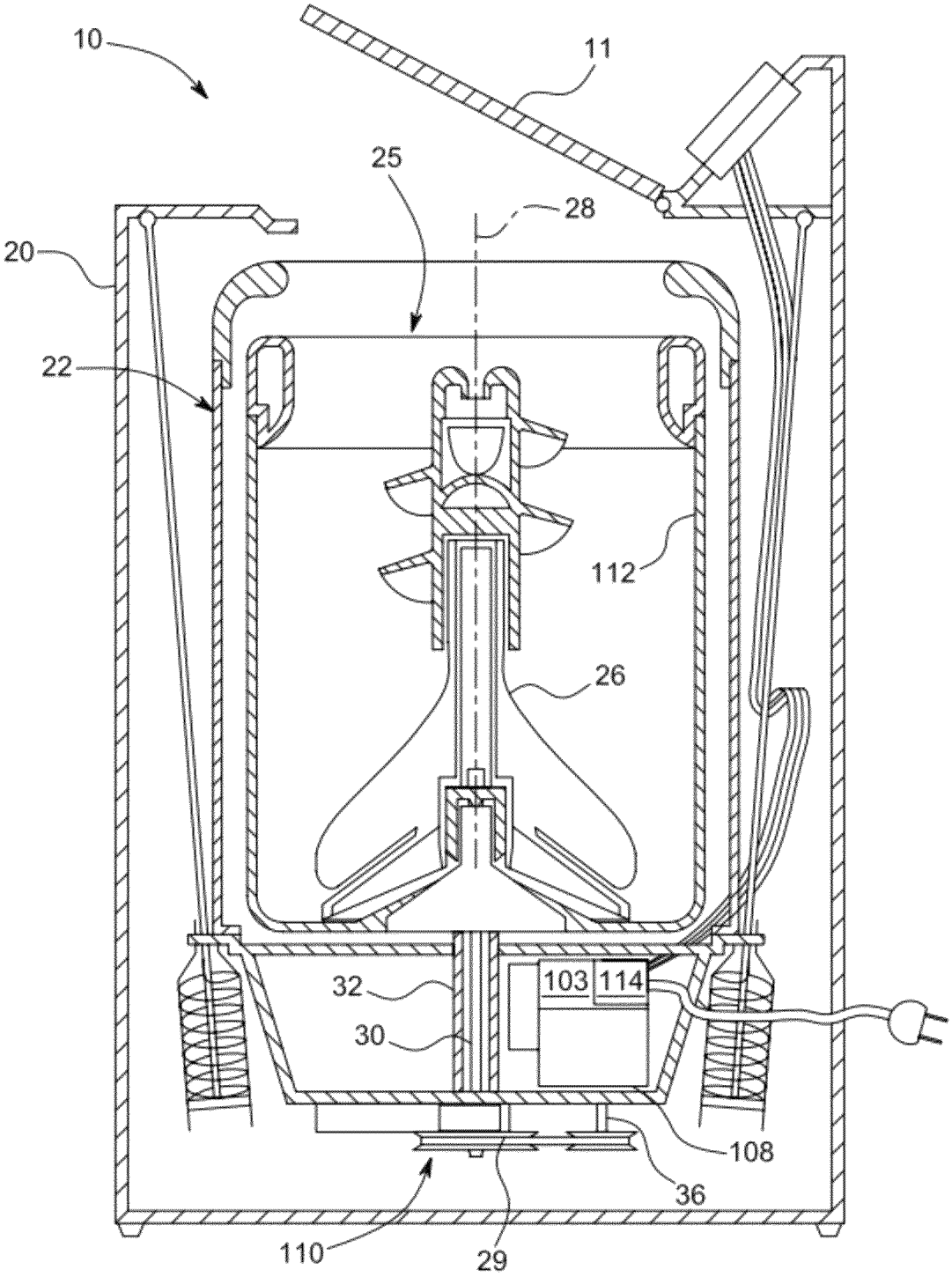
FIG. 3 is a cross-sectional side elevation of an example top-loading washing machine similar to that depicted in FIG. 2.

FIG. 3 shows a cross-sectional side elevation of an example top-loading washing machine 10 similar to that depicted in FIG. 2. Clothes are loaded through door 11 into clothes-receiving opening 25. The machine has an external cabinet 20. A structure 22 is suspended with springs (not separately numbered) and includes basket 112 and agitator 26 revolving about axis 28. The basket 112 is driven by motor 108 via drive arrangement 110; in this case, the latter includes a pulley mounted to motor drive shaft 36 connected by belt 29 to a pulley mechanically linked to basket driveshaft 30 and spin tube 32, which are concentric shafts. Driveshaft 30 is directly coupled to the pulley and belt 29, and drives the agitator. Spin tube 32 is directly coupled to the basket 112. A clutch locks elements 30 and 32 together during spin. Speed sensor 114 is provided on motor driveshaft 36. Motor 108 is controlled by a control unit 103 which may include components such as 104, 106, and 116. As would be appreciated by one skilled in the art, FIG. 3 serves merely as an example, and, as such, additional and/or separate embodiments can be implemented in connection with the invention (such as, for example, the use of an impeller, a direct drive motor, etc.). Additionally, one or more embodiments of the invention can be implemented with additional types of motors such as, a permanent magnet, a direct drive motor, or any motor driven by an inverter.

Figure 5:
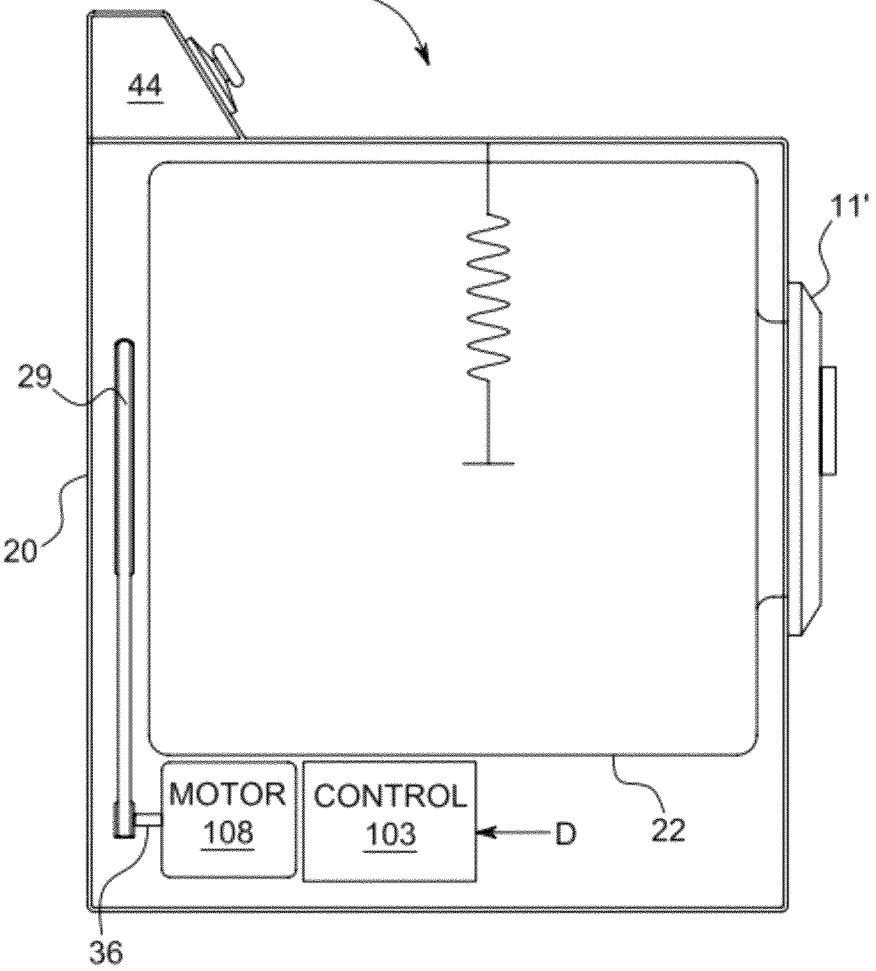
FIG. 5 is a semi-schematic cross-sectional side elevation taken along line VIII-VIII of FIG. 4.
Figure 4:
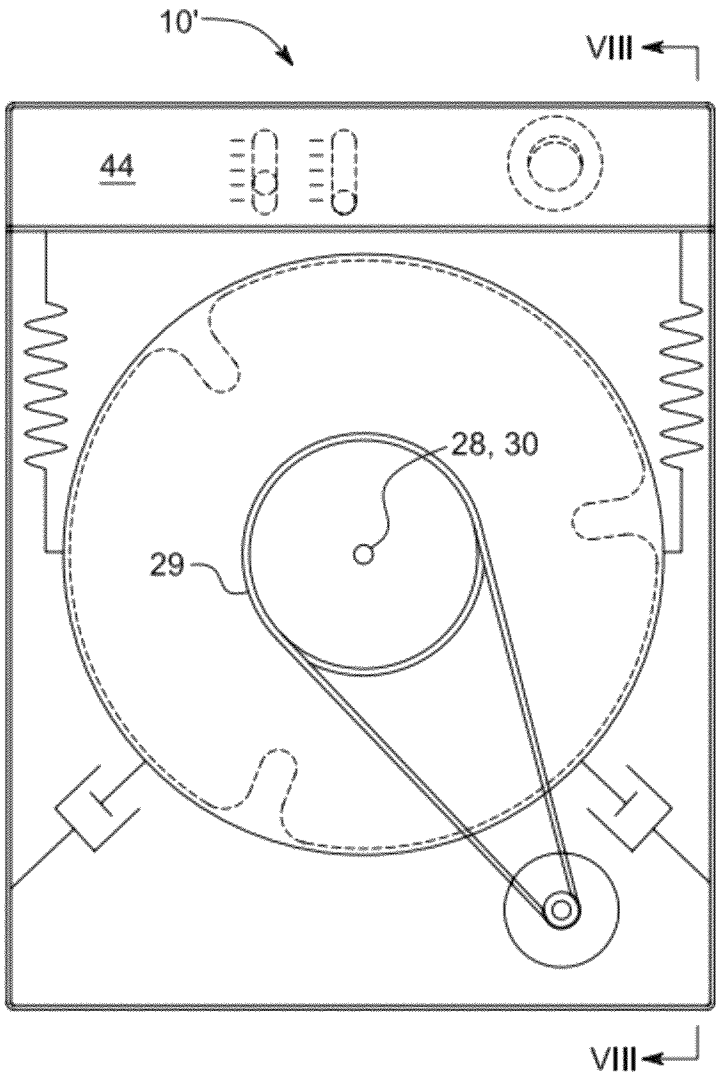
FIG. 4 is a semi-schematic rear elevation of an example front-loading washing machine.

FIG. 4 is a semi-schematic rear elevation of an example front-loading washing machine 10' and FIG. 5 is a semi-schematic cross-sectional side elevation taken along line VIII-VIII of FIG. 4. Machine 10' is another non-limiting example of a machine with which one or more aspects of the invention may be implemented. Clothes are loaded through door 11'. The machine has an external cabinet 20 and a control panel or portion 44. A structure 22 is suspended with springs and dampers (not separately numbered) and may include a basket and agitator revolving about axis 28. The basket is driven by motor 108 via a drive arrangement; in this case, the latter includes a pulley mounted to motor drive shaft 36 connected to a pulley mounted to basket driveshaft 30 by belt 29. A speed sensor can be provided. Motor 108 is controlled by a control unit 103 which may include components such as 104, 106, and 116.

One or more embodiments can be implemented in the software or firmware that controls microprocessor 116 and drives the motor 108 for the washing machine.

As described herein, one or more embodiments of the invention include techniques and apparatuses for utilizing a Venturi effect in a dispenser for a washing machine. As further detailed herein, an apparatus of one or more embodiments of the invention includes fewer parts than existing siphon-effect approaches, facilitates clearing the remaining additive in container, and can be applicable to flow-through dispense systems and bulk dispense systems.

Accordingly, one or more embodiments of the invention include a dispensing system that utilizes a Venturi effect to deliver additives into the washing machine and an inlet water connection to wash/clean the remaining additive from the additive container. A vacuum created by a Venturi component placed in the way of inlet water flow is used to deliver additive from an additive container.

Figure 6:
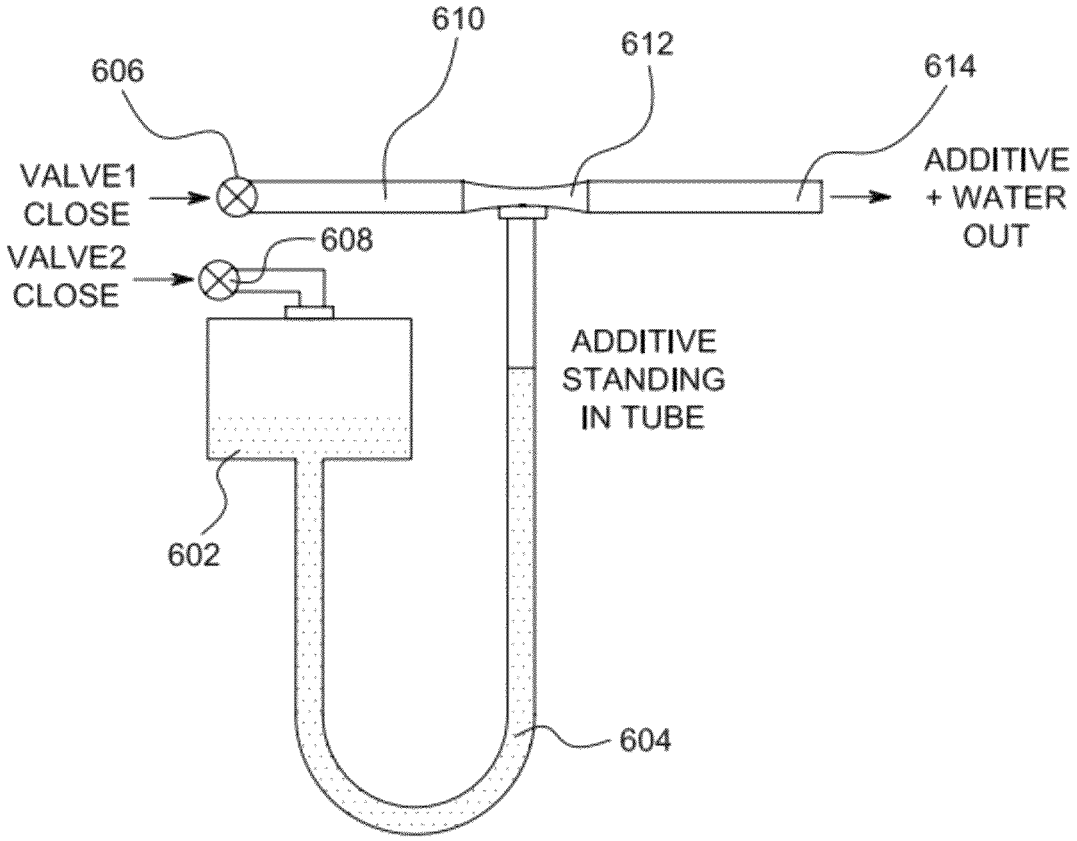
FIG. 6 presents a dispensing system, in accordance with a non-limiting example embodiment of the invention.
Figure 7:
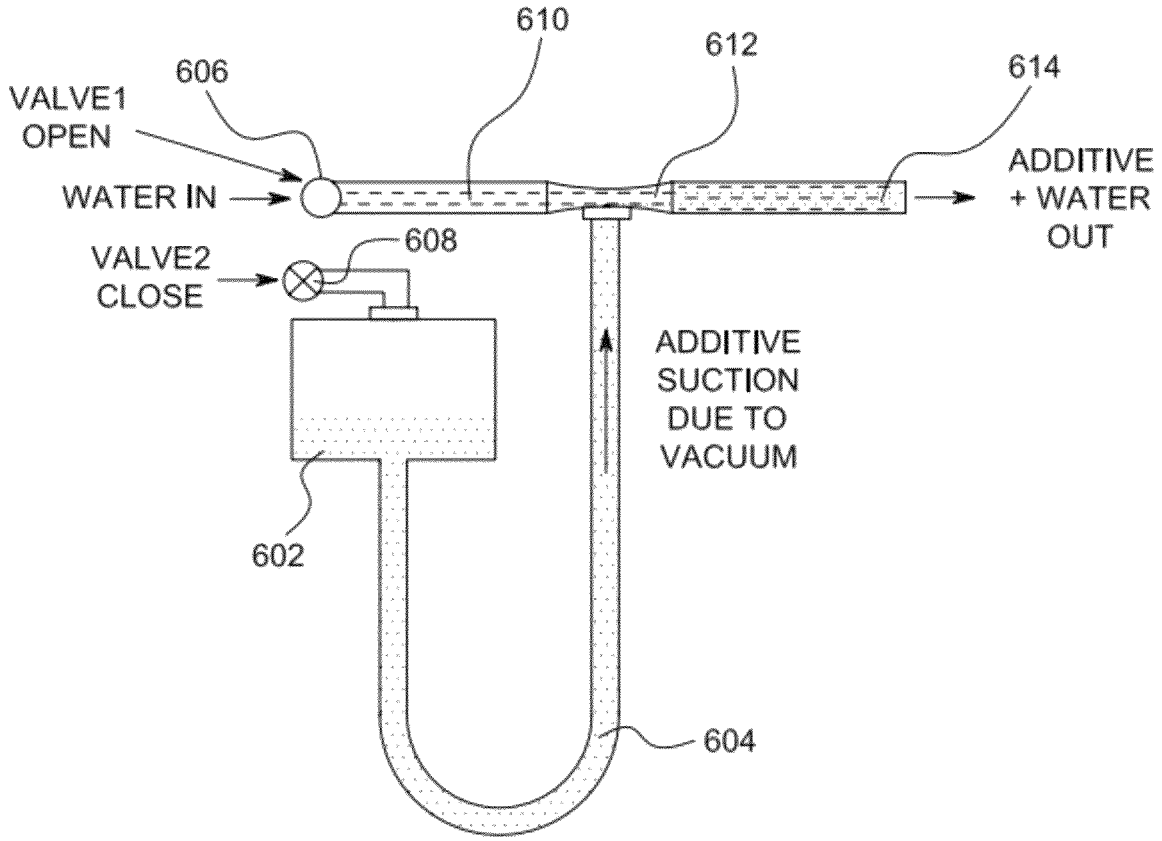
FIG. 7 presents a dispensing system, in accordance with a non-limiting example embodiment of the invention.
Figure 8:
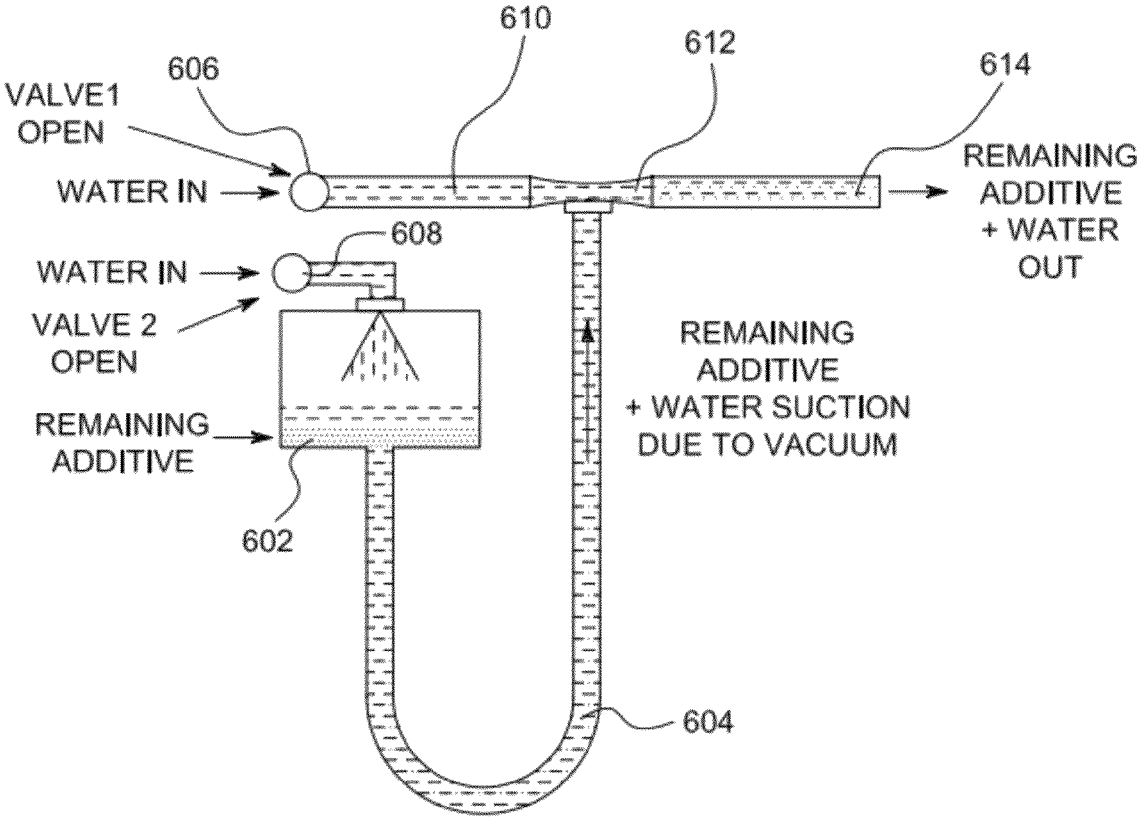
FIG. 8 presents a dispensing system, in accordance with a non-limiting example embodiment of the invention.

As depicted in FIGS. 6-8, the dispensing system described herein includes an additive container 602 connected to the vacuum area of a Venturi component 612 through a U-tube 604 at the bottom of the container. By way of example, detergent can remain in the U-tube 604 until it is needed or ready to be used. One end of Venturi component 612 is connected to the water inlet through inlet hose 610 and the other end to the tub through outlet hose 614. Valve 606 controls the flow of water in inlet hose 610, and valve 608 is provided to control flow in the additive container 602.

As depicted in FIG. 7, based on a signal from controls, valve 606 can open, allowing water flow for certain time duration. Thus, water flows through the Venturi component 612, creating a vacuum in a known area where the U-tube 604 is connected, which results in suction of additive from the additive container 602 into the Venturi component 612 through U-tube 604, which is then carried by water to the tub of the washing machine through the outlet hose 614. At this time, as shown in FIG. 7, valve 608 is closed. As is known in the art, the additive container 602 is not air-tight when the valve 608 is closed.

As depicted in FIG. 8, in one embodiment, after a specified duration of time after, for example, the opening of the valve 606, the valve 608 opens, allowing water to enter into the additive container 602, and as the valve 606 is already open, due to the Venturi effect, water carries the remaining additive to the tub through the U-tube 604 and the outlet hose 614, thus substantially clearing remaining additive from the dispensing system. This is a cleaning process that takes place after the normal additive dispensing process. In other embodiments, the valves 606 and 608 can open at the same time.

Figure 9:
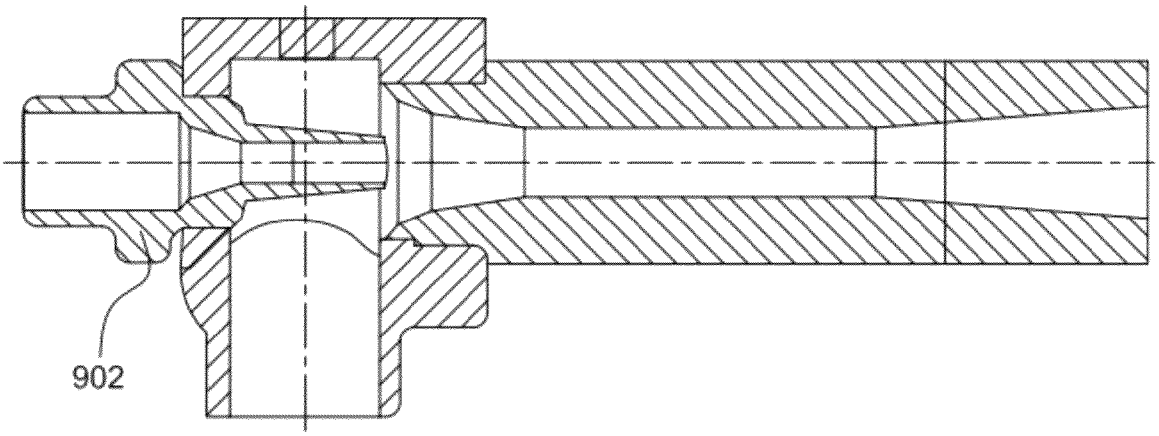
FIG. 9 presents an existing approach jet pump with a protruding nozzle.
Figure 10:
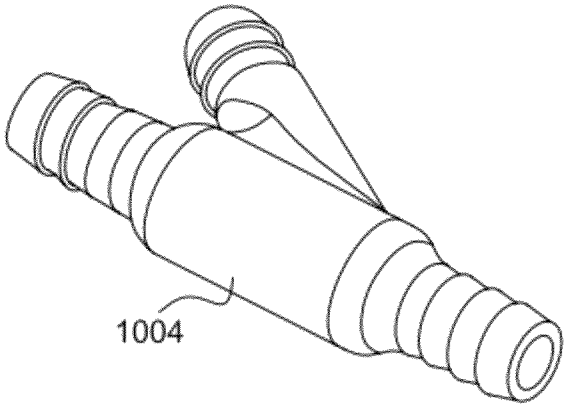
FIG. 10 presents three views of a Venturi component, in accordance with a non-limiting example embodiment of the invention.
Figure 10:
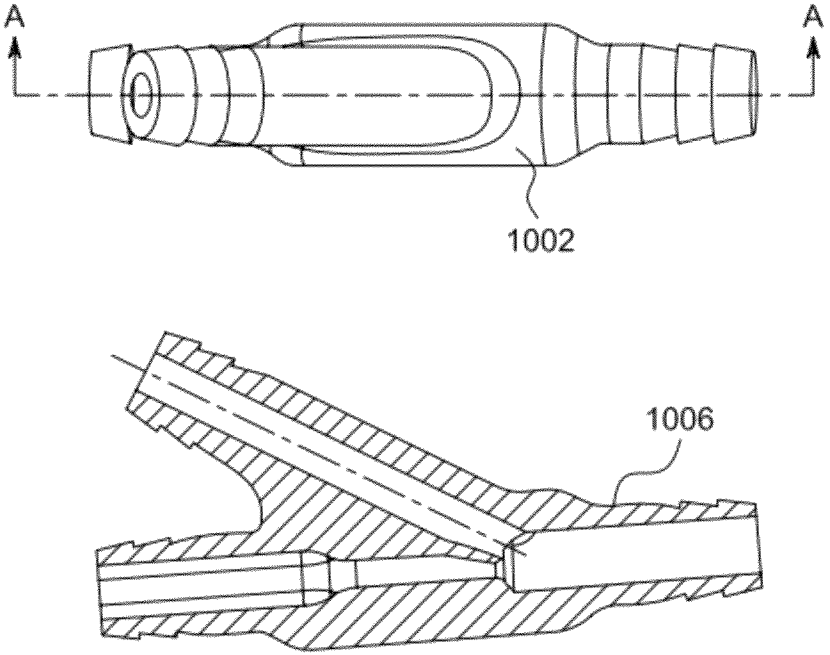

One or more embodiments of the invention also include a dispensing cup for a washing machine utilizing a jet and/or Venturi effect. The dispensing cup can be used to dispense liquids, powder, tablets, pouches, etc., and can be devoid of a nozzle, as opposed to jet pumps having nozzles. FIG. 9 presents an existing approach jet pump with a protruding nozzle 902. Also, FIG. 10 presents three views, 1002, 1004 and 1006, of a Venturi component, in accordance with a non-limiting example embodiment of the invention.

Additionally, the dispensing cup of one or more embodiments of the invention includes no backflow (check) valves, a variable geometry channel to provide uniform flow, as well as a cover (for example, a snap-on channel lid (SOCL).

Figure 11:
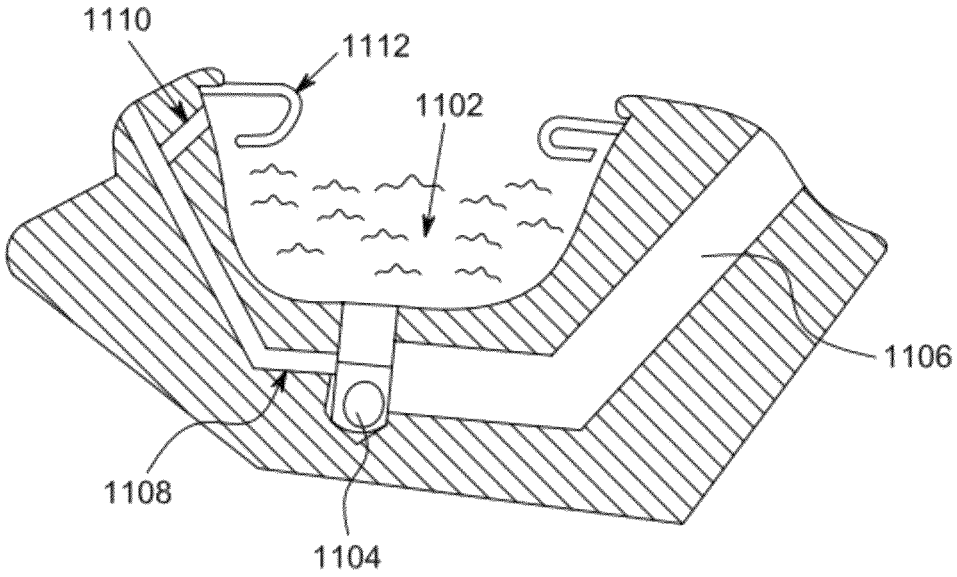
FIG. 11 presents a dispenser cup, in accordance with a non-limiting example embodiment of the invention.
Figure 12A:
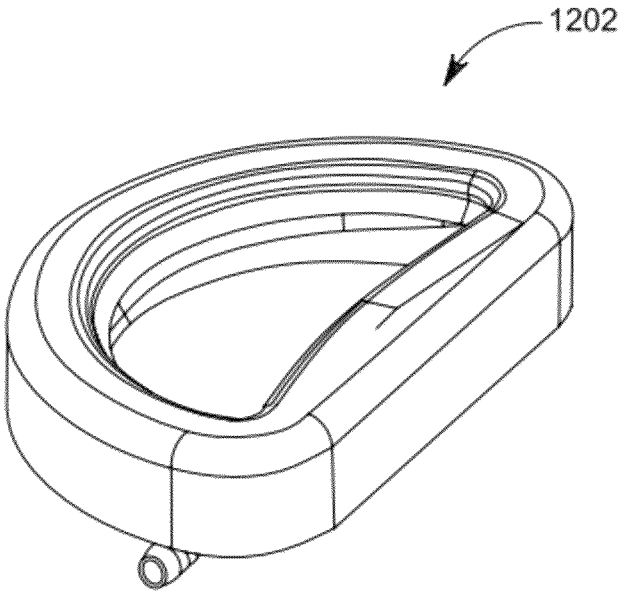
FIG. 12 presents four views of a cover, in accordance with a non-limiting example embodiment of the invention.
Figure 12B:
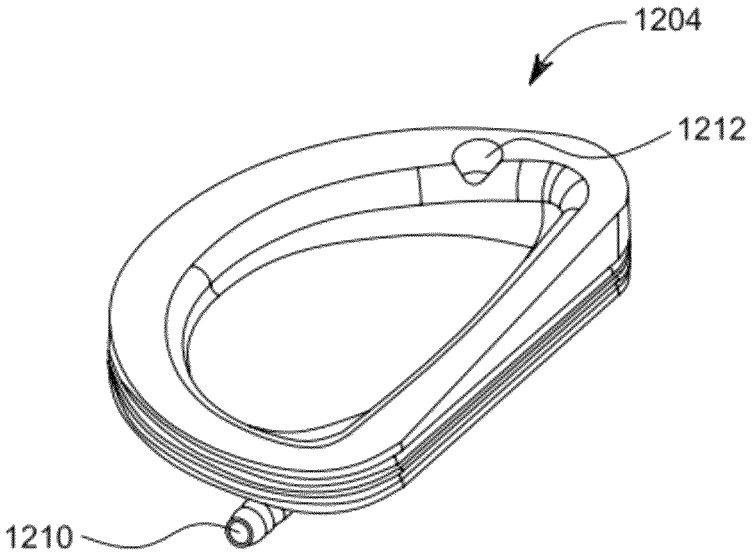
Figure 12C:
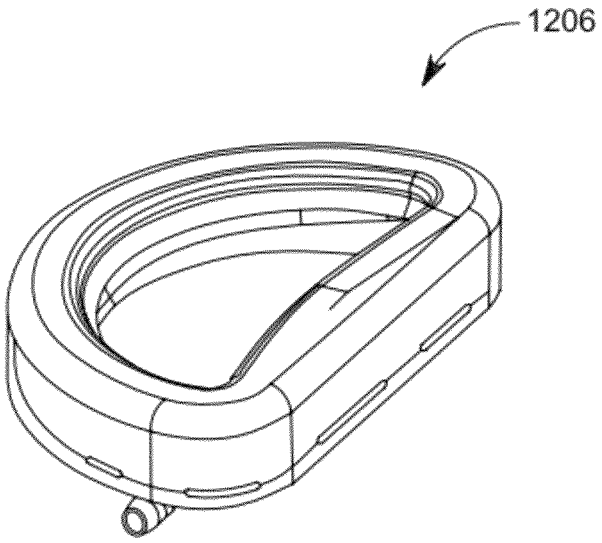
Figure 12D:
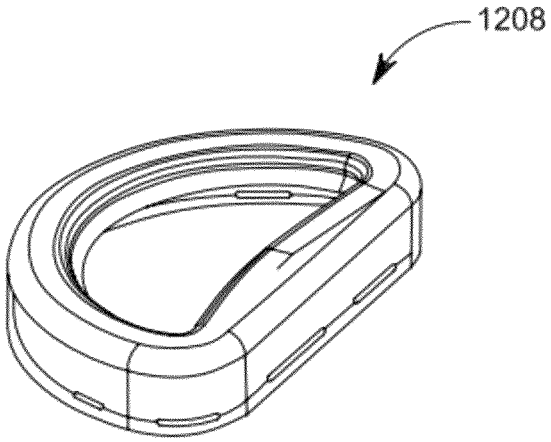

Accordingly, FIG. 11 presents a dispenser cup, in accordance with a non-limiting example embodiment of the invention. By way of illustration, liquids and powder can be poured into chamber 1102. Tablets and pouches can be inserted into chamber 1104. Chamber 1104 can include, for example, a hole or slot in chamber 1102. A jet from the Venturi component 1108 passes through the chamber 1104 and effectively destroys anything on its way. That is, if there is powder detergent (cristalls) or a "pouch with an additive" in chamber 1104, the force/pressure of the water will destroy/break/shatter/etc. it. FIG. 11 also depicts a cover (for example, a SOCL) 1112.

A jet/Venturi component pump in existing approaches normally has a nozzle and made of two parts welded together. Additionally, as depicted in FIG. 11, inclined channels 1106 and 1108 eliminate the use of check valves. Water rushes into the channel 1008 and branches up through the channel 1110 (via pressure) into the variable geometry washing channels formed by the cover 1112 and the cup itself, which allows uniform flow of water and facilitates wash ability of all surfaces of additive cup, as detailed further in connection with FIG. 12, FIG. 13 and FIG. 14.

FIG. 12 presents four views, 1202, 1204, 1206 and 1208, of a cover (for example, a SOCL), in accordance with a non-limiting example embodiment of the invention. View 1204, by way of example, also depicts an entry point 1212 for water to enter the cup, and an outlet point 1210. Between the two points, a variable geometry washing channel helps to wash the entirety of the walls of the cup.

Figure 13:
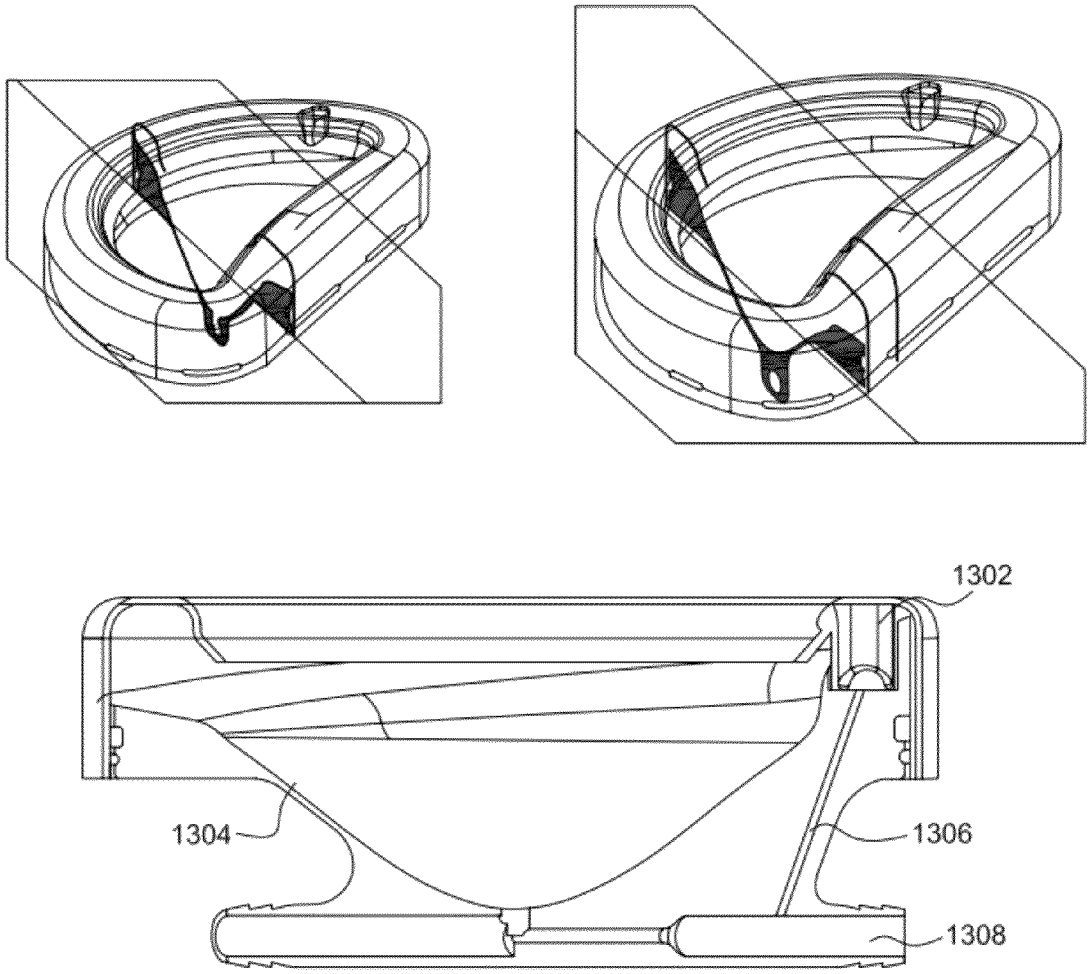
FIG. 13 presents aspects of the cover in the context of the dispensing cup, in accordance with a non-limiting example embodiment of the invention.

FIG. 13 presents aspects of the cover (for example, SOCL) in the context of the dispensing cup, in accordance with a non-limiting example embodiment of the invention. As depicted in the bottom illustration of FIG. 13, water travels through component 1308 and gets forced up (via pressure) through tube 1306 until it contacts the surface of the cover 1302. After contacting the cover 1302, the water travels around the variable geometry washing channel to wash down around the entirety of the walls of the cup 1304, due in part to the fact that the water travels along the gap between the cover and the cup, which increases, as depicted in FIG. 13.

Figure 14:
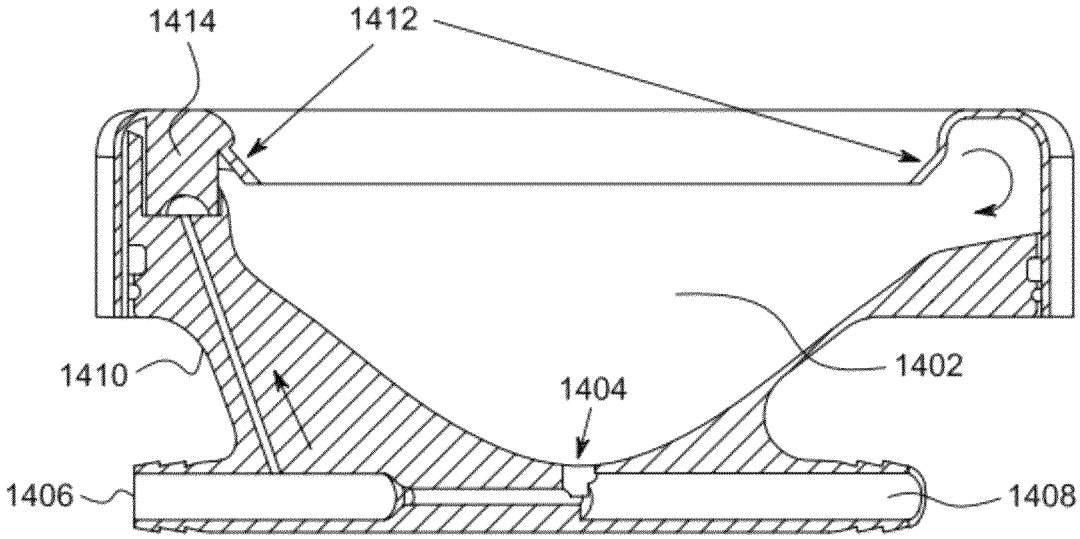
FIG. 14 presents a dispenser cup, in accordance with a non-limiting example embodiment of the invention.

FIG. 14 presents a dispenser cup, in accordance with a non-limiting example embodiment of the invention. By way of illustration, water enters through component 1406 and gets forced up (via pressure) through tube 1410. The water that does not get forced up through tube 1410 continues along and mixes with additive (for example, detergent) which has been output from dispensing cup 1402 through output component 1404. The water-additive mixture continues moving out through component 1408. The water that is forced up through tube 1410 travels until it contacts the surface of the cover 1412 (which can optionally include a tooth 1414). After contacting the cover 1412, the water travels around a variable geometry washing channel to wash down around the entirety of the walls of the cup 1402.

As depicted in example fashion in FIG. 14, tube 1410 can be constructed in such a manner (for example, made narrow enough) to cause the water travelling into cup (via tube 1410 and cover 1412) to do so at a slower rate than that of the additive exiting the cup 1402 via output component 1404. Consequently, the additive can exit the cup, and the water can subsequently enter the cup to wash the cup.

As also illustrated via FIG. 13, FIG. 14 depicts an example of a variable geometry washing channel in cup 1402, as the shape of the cup with respect to the cover 1412 enables water to move from areas of higher water pressure to areas of lower water pressure, thereby facilitating washing around the entirety of the walls of the cup.

Additionally, as depicted in FIG. 14 and other Figures herein, one or more embodiments of the invention enable cup cleaning and dispensing controlled by one water valve. As depicted, for example, in FIG. 14, the water in component 1406 simply branches out via tube 1410 to accomplish both cup cleaning and dispensing.

Figure 15:
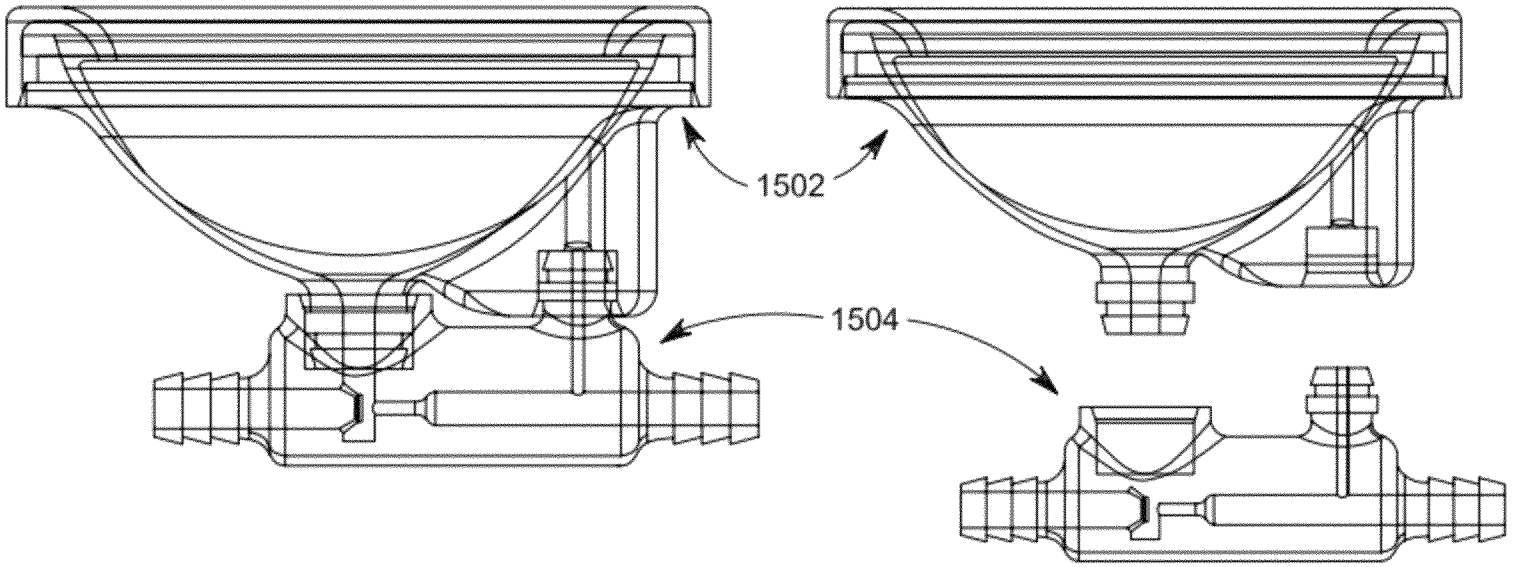
FIG. 15 presents use of a Venturi component and a cup separately, in accordance with a non-limiting example embodiment of the invention.

FIG. 15 presents use of a Venturi component 1504 and a cup 1502 separately, in accordance with a non-limiting example embodiment of the invention. As detailed herein, one or more embodiments of the invention include a Venturi component and a dispensing cup formed to constitute a single piece of equipment. However, in one or more additional embodiments of the invention, such as depicted in FIG. 15, a Venturi component and a dispensing cup can be produced separately and subsequently combined.

One advantage that may be realized in the practice of some embodiments of the described systems and techniques is the ability to clean an additive container (for example, to achieve a status of no residue left in container) via a Venturi effect by controlling the valves. Another advantage that may be realized in the practice of some embodiments of the described systems and techniques is the need for fewer parts than a siphoning dispensing system. Yet another advantage that may be realized is that siphoning dispensing systems have smaller gaps and openings, and hence are prone to clogging, while jet dispensing has larger openings.

Figure 16:
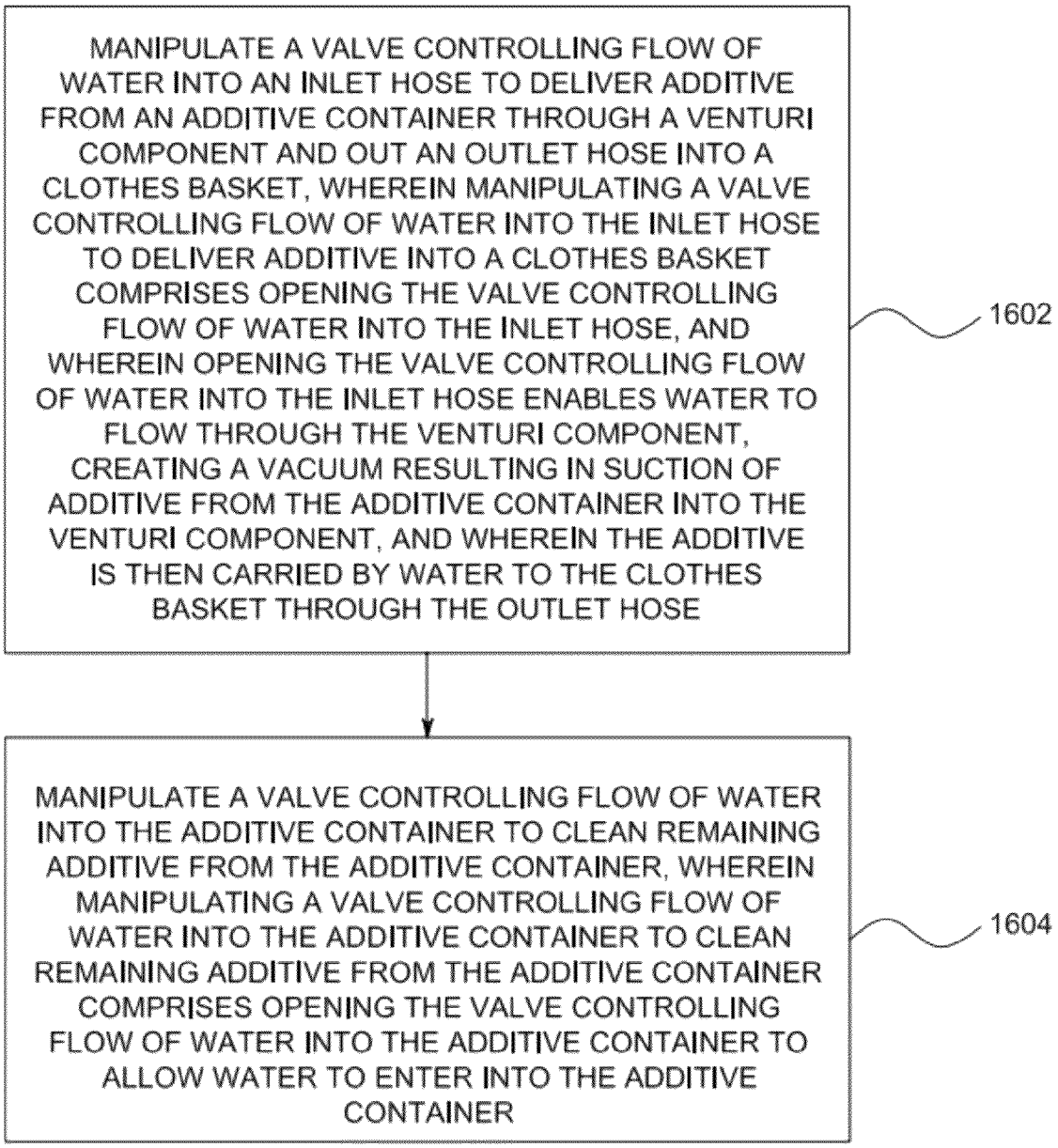
FIG. 16 is a flow chart of a method for delivering additive into a clothes basket and cleaning remaining additive from an additive container, in accordance with a non-limiting example embodiment of the invention.

Reference should now be had to the flow chart of FIG. 16. FIG. 16 is a flow chart of a method for delivering additive into a clothes basket and cleaning remaining additive from an additive container (for example, in a washing machine comprising a clothes basket, an additive container, a Venturi component, a water inlet connected to the Venturi component through an inlet hose, and an outlet hose connecting the Venturi component to the clothes basket), in accordance with a non-limiting example embodiment of the invention.

Step 1602 includes manipulating a valve controlling flow of water into the inlet hose to deliver additive into the clothes basket. Manipulating the valve controlling flow of water into the inlet hose to deliver additive into the clothes basket includes opening the valve controlling flow of water into the inlet hose (for example, for a pre-determined duration of time) and maintaining the valve controlling flow of water into the additive container in a closed position. Opening the valve controlling flow of water into the inlet hose enables water to flow through the Venturi component, creating a vacuum resulting in suction of additive from the additive container into the Venturi component. The additive is then carried by water to the clothes basket through the outlet hose.

Step 1604 includes manipulating a valve controlling flow of water into the additive container to clean remaining additive from the additive container. Manipulating a valve controlling flow of water into the additive container to clean remaining additive from the additive container includes opening the valve controlling flow of water into the additive container to allow water to enter into the additive container. Opening the valve controlling flow of water into the additive container can also include opening that valve after the valve controlling flow of water into the inlet hose has been opened for a pre-determined duration of time, which can be determined by the type and amount of the additive used and the amount of water supplied. In one embodiment, the pre-determined duration of time is about 20 seconds. In other embodiments, the pre-determined duration of time is more or less than 20 seconds.

Further, opening the valve controlling flow of water into the additive container further includes maintaining the valve controlling flow of water into the inlet hose in an open position to enable water to carry remaining additive to the clothes basket through the outlet hose to clean the remaining additive from the additive container.

Furthermore, given the discussion thus far, it will be appreciated that, in general terms, an example apparatus, according to still another aspect of the invention, includes a clothes basket 112 rotatable about an axis 28, a motor 108 coupled to the clothes basket, a sensor 114, a Venturi component (for example, 612), an additive container (for example, 602), wherein the additive container is connected to a vacuum area of the Venturi component through a U-tube (for example, 604), a water inlet connected to the Venturi component through an inlet hose (for example, 610), an outlet hose (for example, 614) connecting the Venturi component to the clothes basket, a valve (for example, 606) controlling flow of water into the inlet hose, a valve (for example, 608) controlling flow of water into the additive container; and a processor (for example, microprocessor 116 or alternative) coupled to the motor, the sensor, and the valves. The processor is operative to control the motor to implement one or more techniques as described herein (for example, manipulating the valve controlling flow of water into the inlet hose and the valve controlling flow of water into the additive container to deliver additive into the clothes basket and to clean remaining additive from the additive container). The axis 28 can have any orientation; in some cases, such as FIGS. 2 and 3, it may be vertical; in other cases, such as FIGS. 4 and 5, it may be substantially horizontal (for example, machines that are perfectly horizontal as well as machines that have a slight tilt and are not perfectly horizontal).

Additionally, one or more embodiments of the invention include a dispensing cup apparatus that includes one or more additive chambers (for example, 1102, 1104), a dispensing cup cover (for example, 1412), a motif fluid (for example, water) valve (for example, 1406), wherein the motif fluid valve facilitates motif fluid to be mixed with additive (for example, liquid additive, powder additive, an additive tablet and/or an additive pouch) from one or more of the one or more additive chambers carried to a washing chamber, and wherein the motif fluid valve also branches out (for example, via a tube) to carry motif fluid towards the dispensing cup cover, and one or more channels (of variable geometry) (for example, 1106, 1110) to provide motif fluid flow along walls of the one or more additive chambers to wash the walls of the one or more additive chambers, wherein the one or more channels are formed based on shape of the dispensing cup with respect to shape of the cover. Shape of the dispensing cup with respect to shape of the cover can include creating a gap between the cover and the dispensing cup that increases from a point of motif fluid entry in the additive chamber to a point of motif fluid exit from the additive chamber, facilitating motif fluid to move from an area of higher fluid pressure to an area of lower fluid pressure.

Further, such an apparatus can include one additive chamber that is a sub-chamber of one of the one or more additive chambers. Additionally, the dispensing cup cover can include, for example, a snap-on cover, a glued-on cover a welded-on cover, etc.

Figure 17:
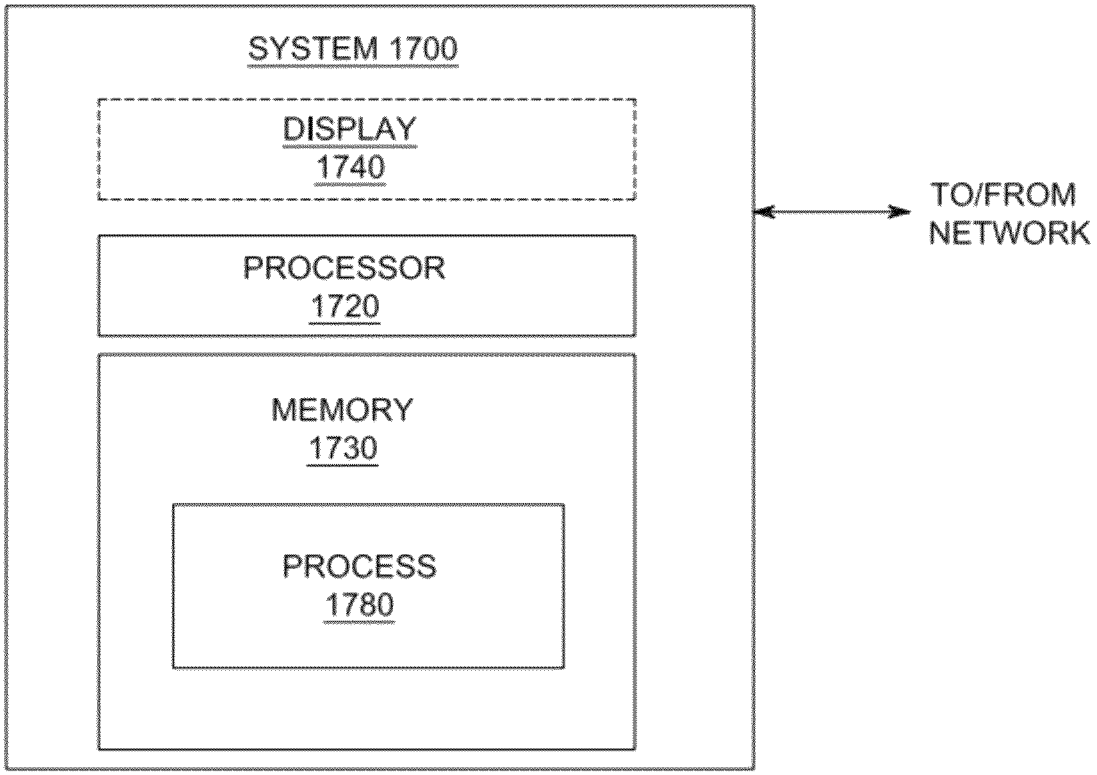
FIG. 17 is a block diagram of an example computer system useful in connection with one or more embodiments of the invention.

Aspects of the invention (for example, microprocessor 116 or other computer system to carry out design methodologies) can employ hardware and/or hardware and software aspects. Software includes but is not limited to firmware, resident software, microcode, etc. FIG. 17 is a block diagram of a system 1700 that can implement part or all of one or more aspects or processes of the invention. As shown in FIG. 17, memory 1730 configures the processor 1720 to implement one or more aspects of the methods, steps, and functions disclosed herein (collectively, shown as process 1780 in FIG. 17). Different method steps could theoretically be performed by different processors. The memory 1730 could be distributed or local and the processor 1720 could be distributed or singular. The memory 1730 could be implemented as an electrical, magnetic or optical memory, or any combination of these or other types of storage devices. It should be noted that if distributed processors are employed (for example, in a design process), each distributed processor that makes up processor 1720 generally contains its own addressable memory space. It should also be noted that some or all of computer system 1700 can be incorporated into an application-specific or general-use integrated circuit. For example, one or more method steps could be implemented in hardware in an application specific integrated circuit rather than using firmware. Display 1740 is representative of a variety of possible input/output devices.

As is known in the art, part or all of one or more aspects of the methods and apparatus discussed herein may be distributed as an article of manufacture that itself comprises a tangible computer readable recordable storage medium having computer readable code means embodied thereon. The computer readable program code means is operable, in conjunction with a compute system or microprocessor, to carry out all or some of the steps to perform the methods or create the apparatuses discussed herein. A computer-usable medium may, in general, be a recordable medium (for example, floppy disks, hard drives, compact disks, EEPROMs, or memory cards) or may be a transmission medium (for example, a network comprising fiber-optics, the world-wide web, cables, or a wireless channel using time-division multiple access, code-division multiple access, or other radio-frequency channel). Any medium known or developed that can store information suitable for use with a computer system may be used. The computer-readable code means is any mechanism for allowing a computer (for example, processor 116) to read instructions and data, such as magnetic variations on a magnetic media or height variations on the surface of a compact disk. The medium can be distributed on multiple physical devices (or over multiple networks). As used herein, a tangible computer-readable recordable storage medium is intended to encompass a recordable medium, examples of which are set forth above, but is not intended to encompass a transmission medium or disembodied signal. Processor 116 may include and/or be coupled to a suitable memory.

The computer system can contain a memory that will configure associated processors to implement the methods, steps, and functions disclosed herein. The memories could be distributed or local and the processors could be distributed or singular. The memories could be implemented as an electrical, magnetic or optical memory, or any combination of these or other types of storage devices. Moreover, the term "memory" should be construed broadly enough to encompass any information able to be read from or written to an address in the addressable space accessed by an associated processor. With this definition, information on a network is still within a memory because the associated processor can retrieve the information from the network.

Accordingly, it will be appreciated that one or more embodiments of the present invention can include a computer program comprising computer program code means adapted to perform one or all of the steps of any methods or claims set forth herein when such program is run on a computer, and that such program may be embodied on a computer readable medium. Further, one or more embodiments of the present invention can include a computer comprising code adapted to cause the computer to carry out one or more steps of methods or claims set forth herein, together with one or more apparatus elements or features as depicted and described herein.

It will be understood that processors or computers employed in some aspects may or may not include a display, keyboard, or other input/output components.

Thus, while there have shown and described and pointed out fundamental novel features of the invention as applied to example embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A dispensing cup apparatus comprising:

a dispensing cup comprising one or more additive chambers;

a dispensing cup cover;

a motif fluid valve, wherein the motif fluid valve facilitates motif fluid to be mixed with additive from one or more of the one or more additive chambers carried to a washing chamber, and wherein the motif fluid valve also branches out to carry motif fluid towards the dispensing cup cover; and one or more channels to provide motif fluid flow along walls of the one or more additive chambers to wash the walls of the one or more additive chambers, wherein the one or more channels comprise a gap between the cover and the dispensing cup that increases from a point of motif fluid entry in the additive chamber to a point of motif fluid exit from the additive chamber, facilitating motif fluid to move from an area of higher fluid pressure to an area of lower fluid pressure.

2. The apparatus of claim 1, wherein one of the one or more additive chambers holds at least one of a liquid additive, a powder additive, an additive tablet and an additive pouch.

3. The apparatus of claim 1, wherein one additive chamber is a sub-chamber of one of the one or more additive chambers.

4. The apparatus of claim 1, wherein the dispensing cup cover comprises at least one of a snap-on cover, a glued-on cover and a welded-on cover.

5. The apparatus of claim 1, wherein the motif fluid comprises water.

6. The dispensing cup apparatus of claim 1, further comprising a tube connecting the motif fluid valve to the point of motif fluid entry in the additive chamber and an output component at the point of motif fluid exit from the additive chamber, wherein the tube is narrower than the output component.

* * * * *